US010046587B1

(12) United States Patent
Buttner et al.

(10) Patent No.: US 10,046,587 B1
(45) Date of Patent: Aug. 14, 2018

(54) CARD WITH CONTAINER

(71) Applicant: Woke Industries LLC, Bogota, NJ (US)

(72) Inventors: Chelsea Buttner, Bogota, NJ (US); Thomas J. Buttner, Bogota, NJ (US); Elizabeth Kim, Bogota, NJ (US)

(73) Assignee: Woke Industries LLC, Bogota, NJ (US)

( * ) Notice: Subject to any disclaimer, the term of this patent is extended or adjusted under 35 U.S.C. 154(b) by 0 days.

(21) Appl. No.: 15/897,861

(22) Filed: Feb. 15, 2018

Related U.S. Application Data

(63) Continuation-in-part of application No. 29/594,087, filed on Feb. 15, 2017, now Pat. No. Des. 809,933.

(51) Int. Cl.
*B42D 15/04* (2006.01)
*B65D 73/00* (2006.01)

(52) U.S. Cl.
CPC ..... *B42D 15/045* (2013.01); *B65D 73/0078* (2013.01)

(58) Field of Classification Search
CPC ..... B42D 15/045; B65D 73/0078
See application file for complete search history.

(56) References Cited

U.S. PATENT DOCUMENTS

| | | | | |
|---|---|---|---|---|
| 2,609,639 | A * | 9/1952 | Barker | B42D 15/042 446/150 |
| 3,974,957 | A * | 8/1976 | Benzon-Petersen | B65D 33/243 206/470 |
| 5,595,008 | A * | 1/1997 | Johnson | B42D 15/04 283/117 |
| 5,782,357 | A * | 7/1998 | Johnson | B42D 15/045 206/461 |
| 2006/0000730 | A1* | 1/2006 | Llano | B65D 5/008 206/362.4 |
| 2006/0151992 | A1* | 7/2006 | Balderston | B42D 15/045 283/106 |
| 2007/0262125 | A1* | 11/2007 | Precheur | B42D 15/045 229/92.8 |
| 2018/0099799 | A1* | 4/2018 | Murphy | B65D 79/00 |

* cited by examiner

*Primary Examiner* — Gary C Hoge
(74) *Attorney, Agent, or Firm* — Gloria Tsui-Yip; Wendi E. Uzar

(57) ABSTRACT

A greeting card having a unique die cut and scored line pattern and a container to be inserted into the binding area of the card. The greeting card and container includes a sheet like element having first, second, third and fourth scored lines forming the binding area, first, second, third, and fourth die cuts creating first and second tabs at the binding area for receiving the container.

18 Claims, 12 Drawing Sheets

CARD WITH CONTAINER

FIELD OF THE INVENTION

The invention relates to a greeting card. In particular, an improved device that provides a greeting card in combination with a container. The device further provides a unique die cut and scored line pattern to allow for a tube container to be inserted in the binding area of the card. The unique die cut and scored line pattern allows for the binding area to be wider at the top of the card to allow for easy insertion of the container, while the pattern is narrower at the bottom of the card to hold the container more securely.

BACKGROUND OF THE INVENTION

Greeting cards are commonly given to celebrate birthdays, holidays, graduations, anniversaries, weddings, the arrival of a new baby, etc. A typical greeting card comprises one sheet like element or page folded along a centered scored line. This causes the greeting card to take the form of a two page pamphlet or booklet. Verbiage and/or pictures and graphics are typically included on the first, outside, surface on the front page of the pamphlet. Additional verbiage and/or pictures are typically included on the second, inside, surface on the second page of the pamphlet.

A customer, or card giver, typically chooses a greeting card having verbiage and/or pictures they like that are appropriate for the holiday and or occasion causing the card giving. The customer usually adds a personalized message on the second, inside, surface of the card and then the card is inserted into an envelope. However, for most holidays and/or celebrations that customers purchase greeting cards for, it would be given along with a gift. If a card giver wishes to give the gift of money in the form of cash or a check, the cash or check is typically sandwiched in the inside surface of the folded card before it is inserted in the envelope. However, this has its drawbacks as the person receiving the card does not know it contains cash or a check when he/she opens it, and many times the cash or check will fall out of the card causing it to go missing or become lost. Cards with flat pockets are known in the art but then the check or cash can potentially block the verbiage or design on the card. Further, if a card giver wishes to give a small gift such as a cigarette, piece of jewelry, herbs, candy, or any other small token they must separately wrap the gift and attach it to the card as the existing flat pocket cannot hold and secure such bulky items.

Therefore, there is a need for an improved greeting card that can hold and secure cash, check, cigarettes, or small gift as an integral part of the greeting card.

SUMMARY OF THE INVENTION

The present invention provides a novel and unique greeting card comprising a unique die cut and scored line pattern and container to be inserted into the binding area of the card. The distance between the scored lines provides a wider binding area towards the top edge of the card to allow for easy insertion of the container, while the distance between the scored lines provides a narrower binding area at the bottom edge of the card to hold the container more securely within a die cut tab. The card may be a rectangle, square, circle or any shape and of various sizes. The container has a cavity for receiving a gift. The container may be a tube, bottle or other vessel. The container may be cylindrical, square, or any shape or prism.

The greeting card comprises a sheet like element having a top edge and a bottom edge, a central line of symmetry extending from the top edge to the bottom edge, a first surface and a second, opposing, surface, and first, second, third and fourth scored lines extending from the top edge of the sheet like element to the bottom edge of the sheet like element. The scored lines extend, not perpendicularly, from the top edge to the bottom edge of the sheet like element such that the first scored line is spaced further apart from the fourth scored line at the top edge of the sheet like element (distance x1) than at the bottom edge of the sheet like element (distance y1). Similarly, the second scored line is spaced further apart from the third scored line at the top edge of the sheet like element (distance x2) than at the bottom edge of the sheet like element (distance y2). The first scored line runs parallel to the second scored line and the third scored line runs parallel to the fourth scored line.

The card further comprises first and second die cuts that extend substantially perpendicular to said line of symmetry of the sheet like element, from the first scored line to the fourth scored line, creating a first tab. Third and fourth die cuts that extend substantially parallel to the first and second die cuts, from the first scored line to the fourth scored line, create a second tab that is spaced apart from the first tab. The third and fourth die cuts do not have to be parallel to the first and second die cuts. The first and second tabs are trapezoidal in shape due to the non-perpendicular angle of the first scored line and the fourth scored line. Preferably, the second tab is narrower than the first tab as a result of it being closer to the bottom edge of the sheet like element.

The present invention further comprises a container that is capable of being received through the first and second tabs when the card is in a folded or partially folded position. The container is held between the first surface of the first tab and the second tab and the second surface of the binding area of the card. As the first tab is wider than the second tab, the container can easily be inserted in between the first surface of the first tab and the second surface of the binding area of the card and then slid down and fit more securely in between the first surface of the second tab and the second surface of the binding area of the card. In one embodiment of the present invention, the container is substantially the same height as the distance from the top edge of the sheet like element to the bottom edge of the sheet like element. The container advantageously reinforces the binding area of the card. In one embodiment of the present invention, the container has a removable cover.

In the folded position of a booklet, the card may contain verbiage and/or graphics on the first surface on the cover page and the second surface on the second page as is seen in traditional greeting cards.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
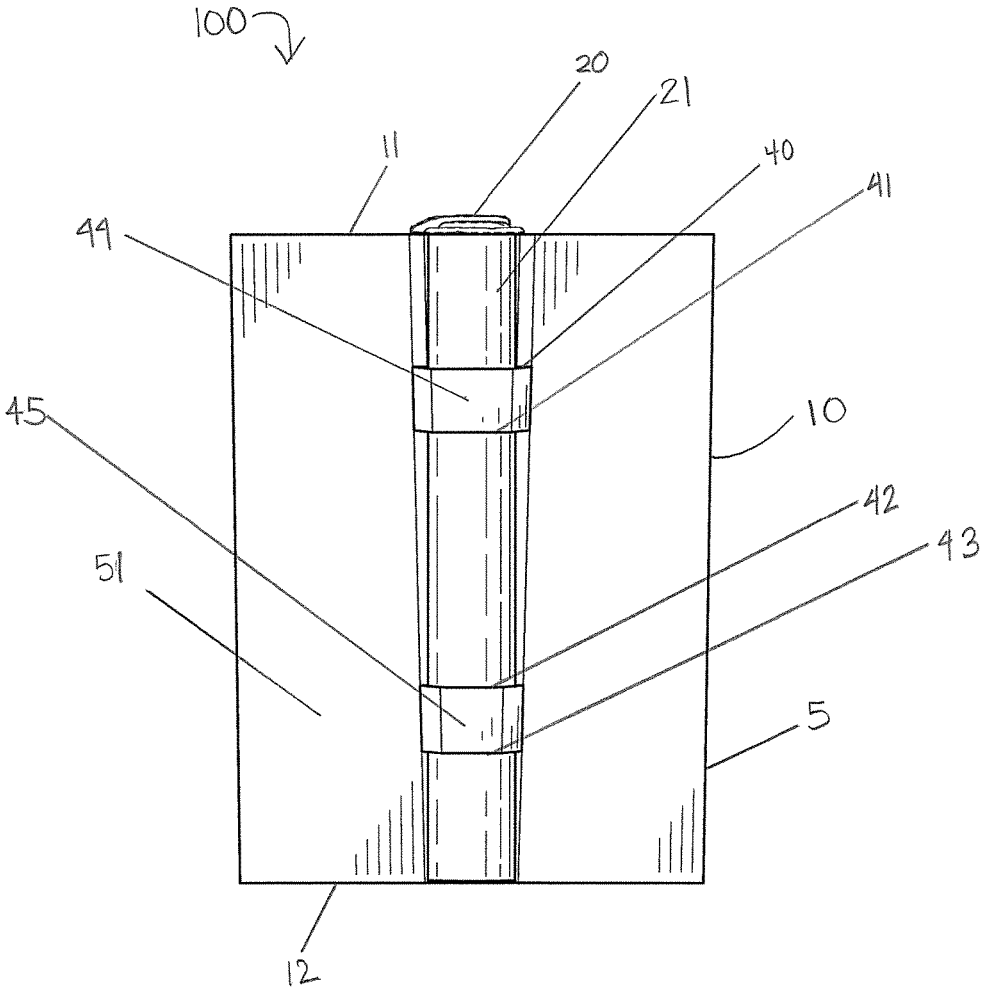
FIG. 1 is a front elevational view of the card of the present invention in a partially folded position.
Figure 2:
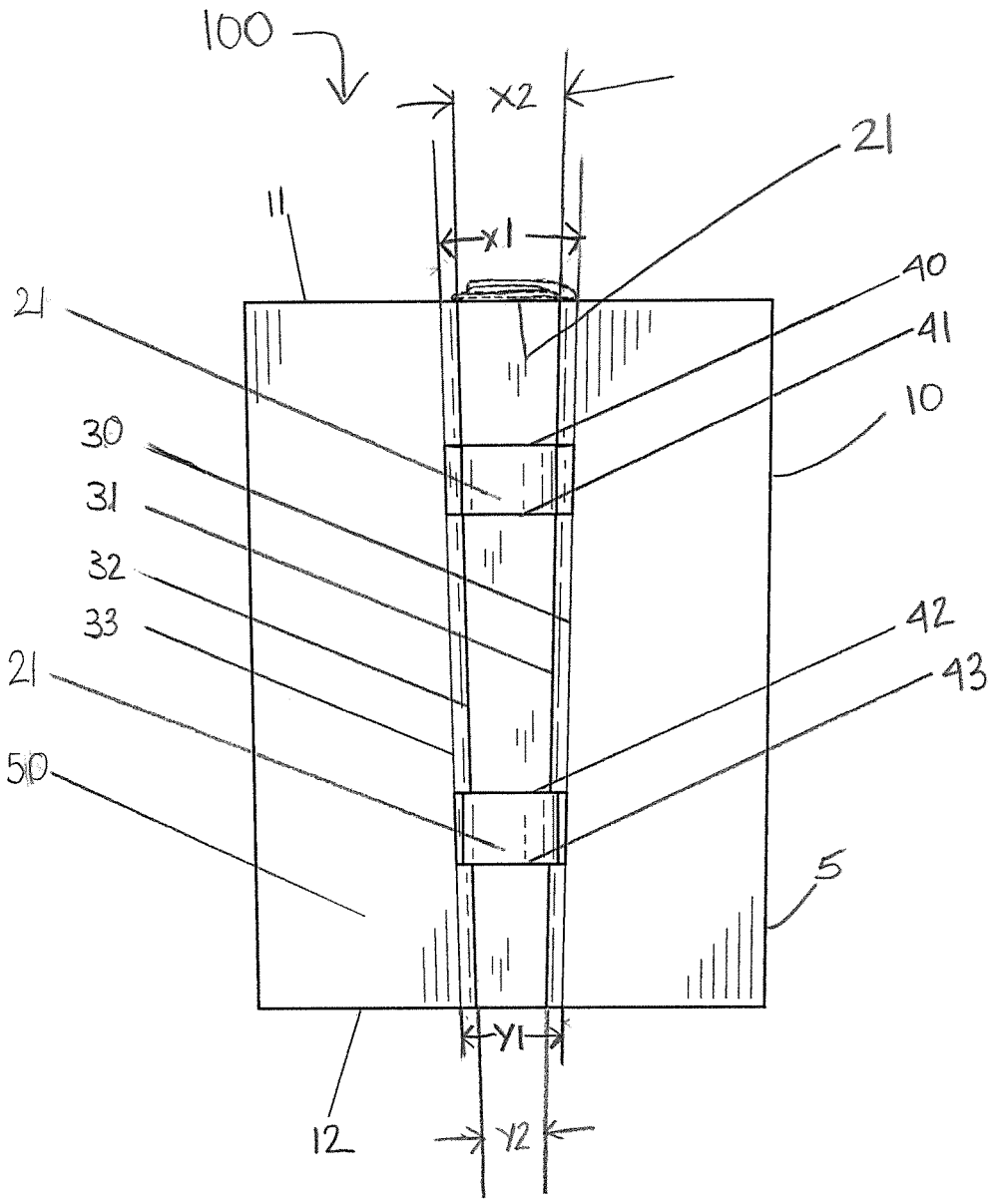
FIG. 2 is a rear elevational view of FIG. 1.
Figure 3:
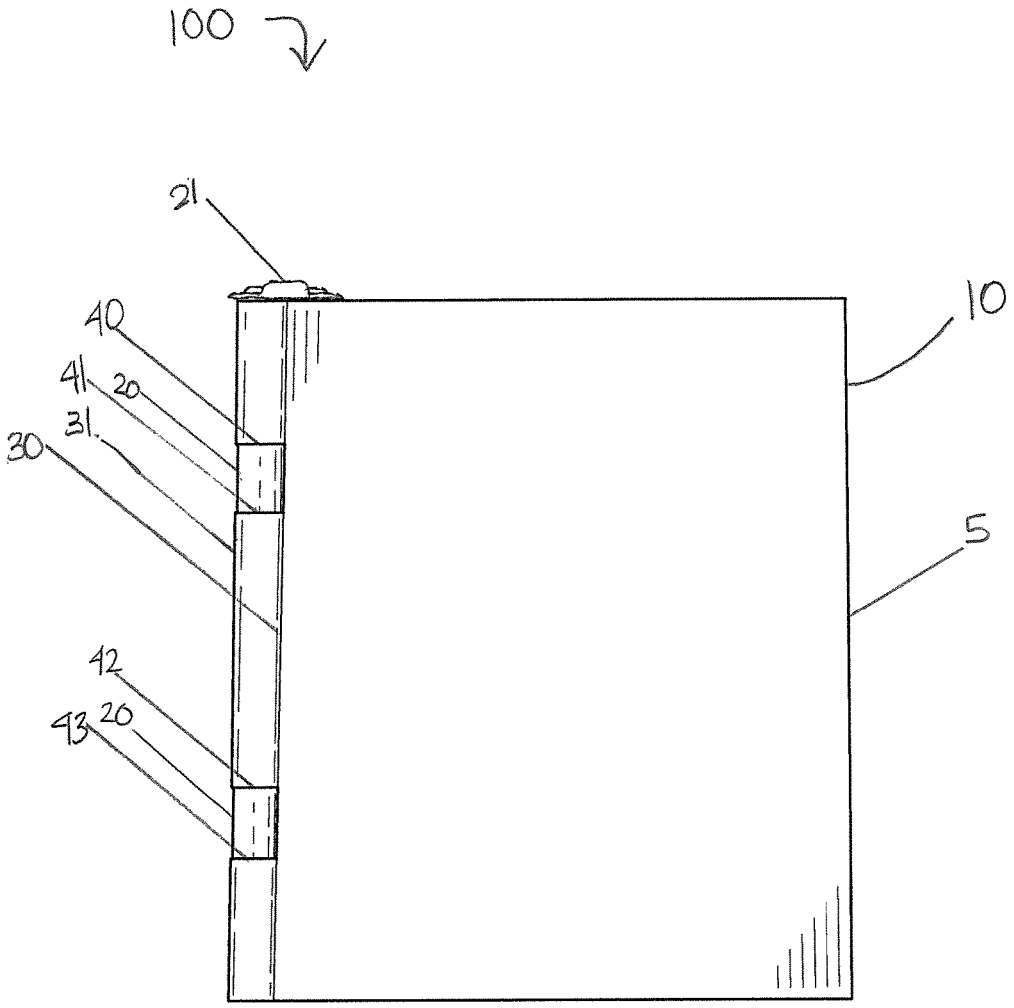
FIG. 3 is a left side view of FIG. 1.
Figure 4:
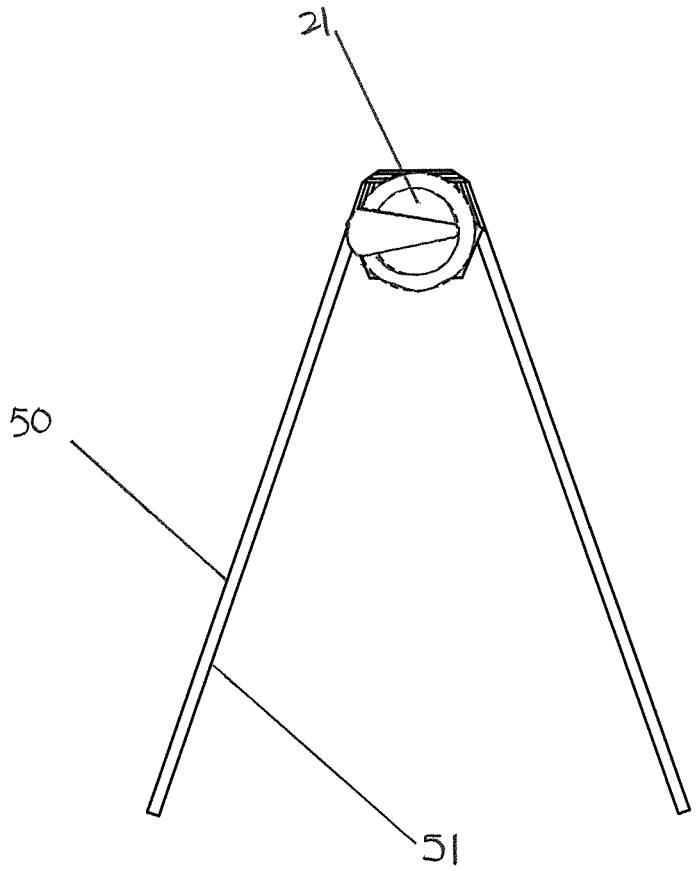
FIG. 4 is a top plan view of FIG. 1.
Figure 5:
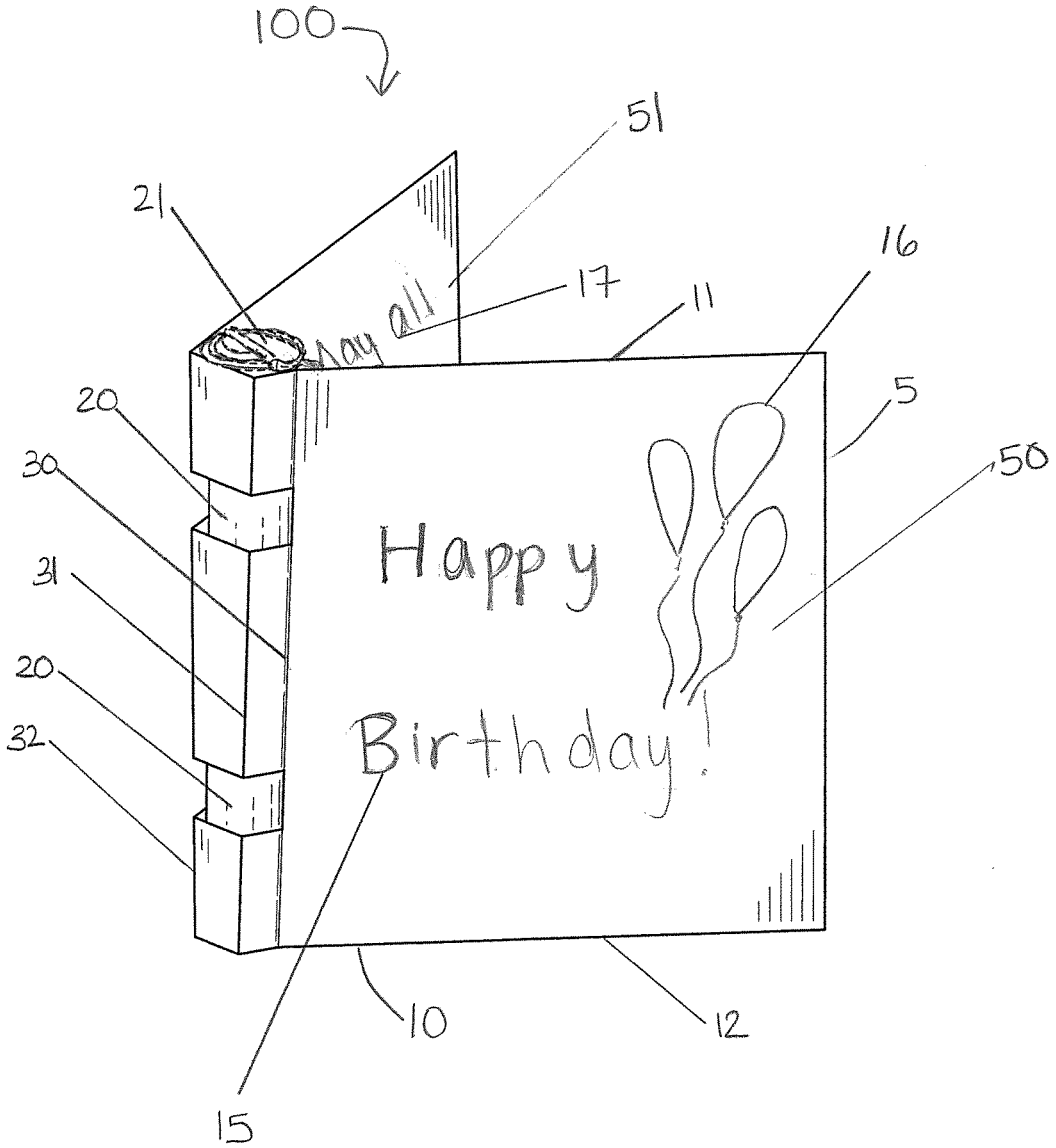
FIG. 5 is a perspective view of FIG. 1.

With reference to the drawings, wherein the same reference number indicates the same element throughout, there is shown in FIG. 5 a perspective view of the card and container combination 100 of the present invention. As shown in FIGS. 1 and 5, the card 5 comprises a sheet like element 10 having a top edge 11 and a bottom edge 12, a first outside surface 50 and a second opposite, inside, surface 51, and first 30, second 31, third 32, and fourth 33 scored lines extending from the top edge 11 of the sheet like element 10 to the bottom edge 12 of the sheet like element 10. The first scored line 30 is proximate to the second scored line 31 which is proximate to the third scored line 32, which is proximate to the fourth scored line 33. There is a line of symmetry at the center line of the card 5 extending from the top edge 11 to the bottom edge 12. The first 30 and second 31 scored lines are symmetrical to the fourth 33 and third 32 scored lines respectively. The second 31 and third 32 scored lines are closer to the line of symmetry than the first 30 and fourth 33 scored lines. The first 30, second 31, third 32 and fourth 33 scored lines extend, not perpendicularly, from the top edge 11 to the bottom edge 12 of the sheet like element 10. The first scored line 30 is spaced further apart from the fourth scored line 33 at the top edge 11 of the sheet like element 10 (distance x1) than at the bottom edge 12 of the sheet like element 10 (distance y1). Similarly, the second scored line 31 is spaced further apart from the third scored line 32 at the top edge 11 of the sheet like element (distance x2) than at the bottom edge 12 of the sheet like element (distance y2). The first scored line 30 is parallel to the second scored line 31 and the third scored line 32 is parallel to the fourth scored line 33.

Figure 6:
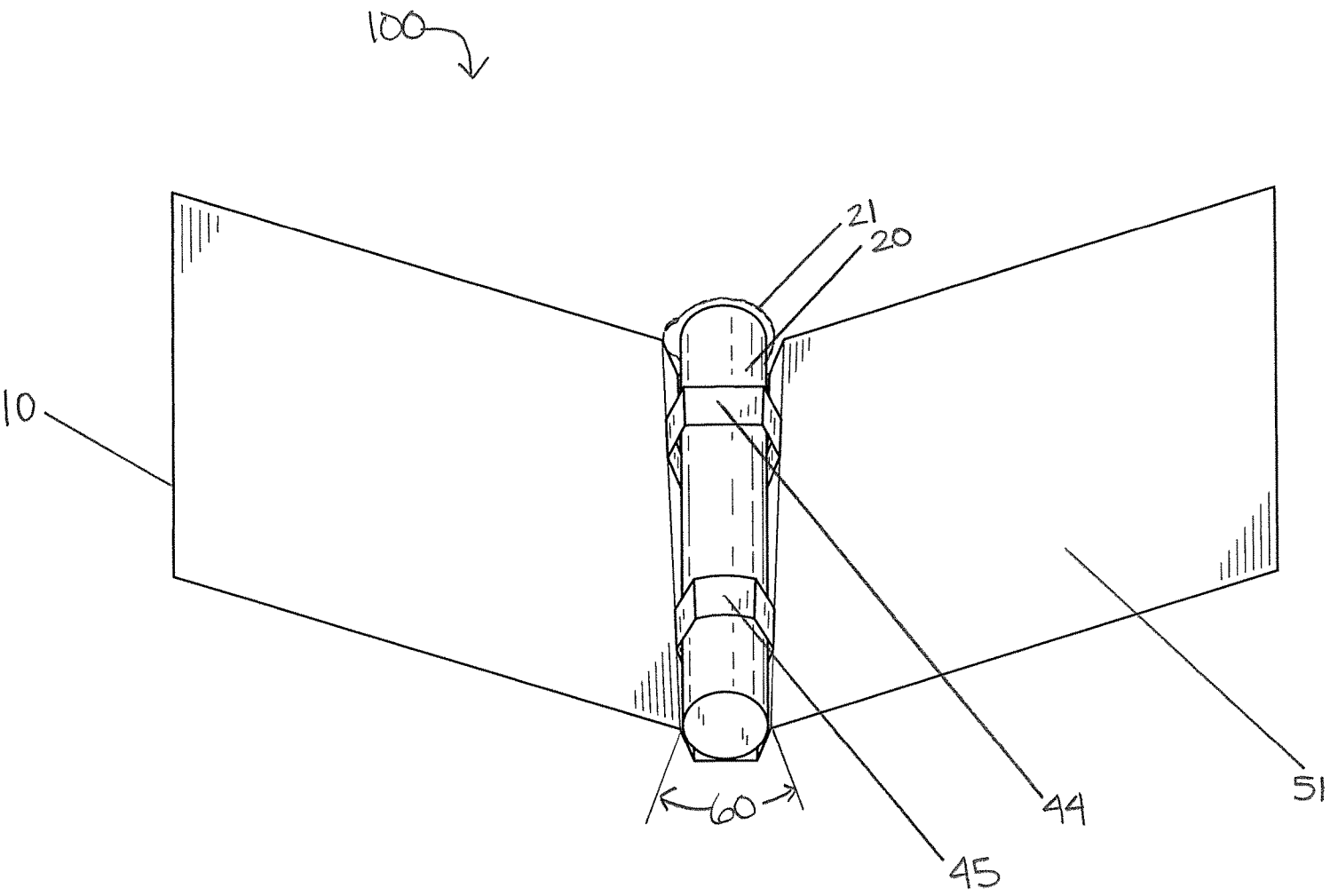
FIG. 6 is an alternate perspective view of FIG. 1.
Figure 7:
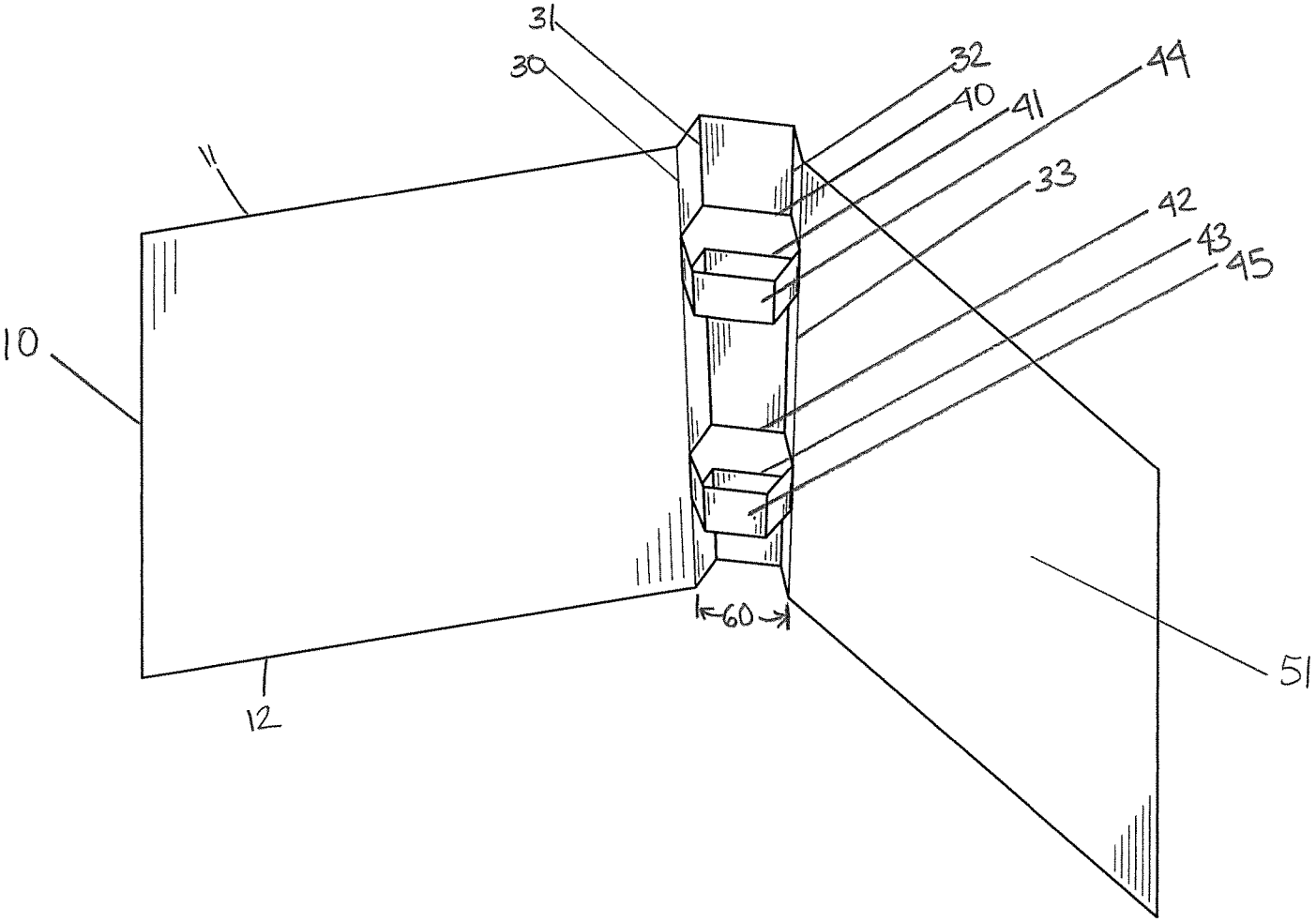
FIG. 7 is FIG. 6 without the container of the present invention shown at a different angle.
Figure 9:
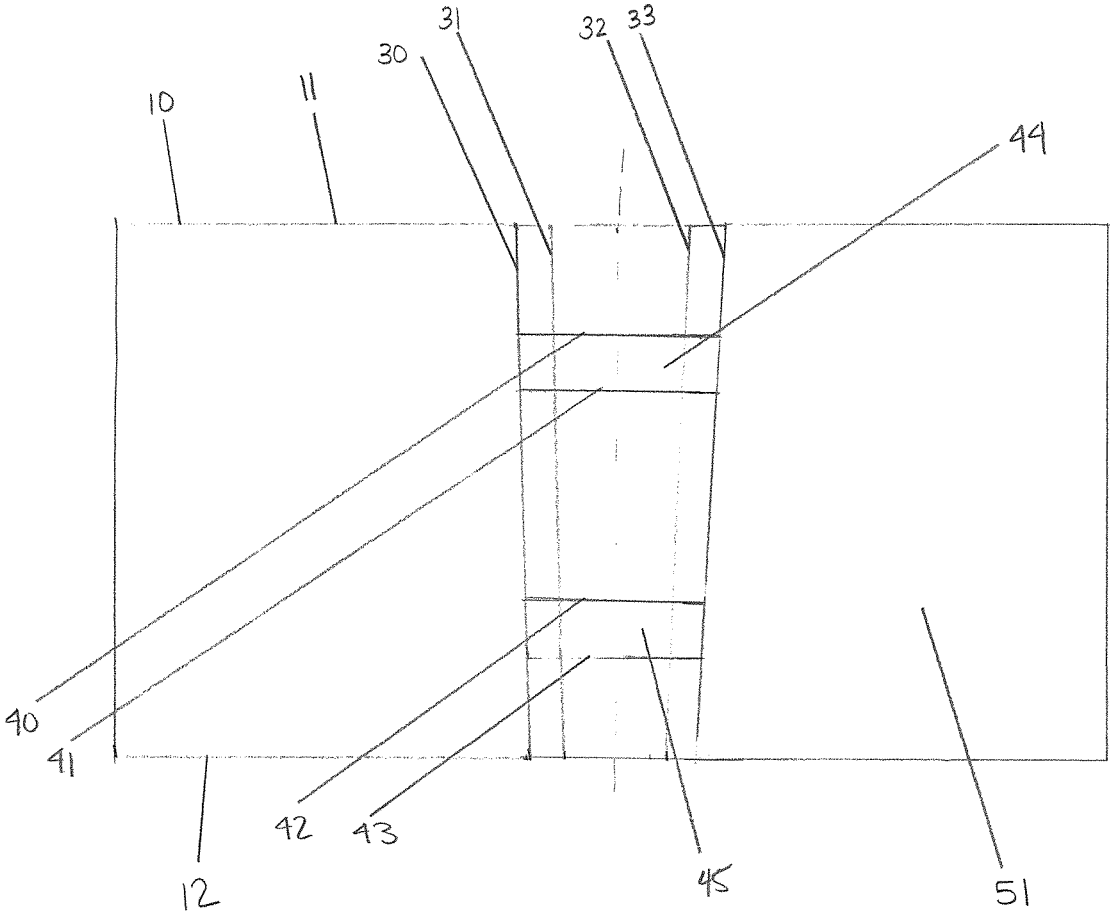
FIG. 9 is a top plan view of the present invention in an unfolded position without the container.
Figure 11:
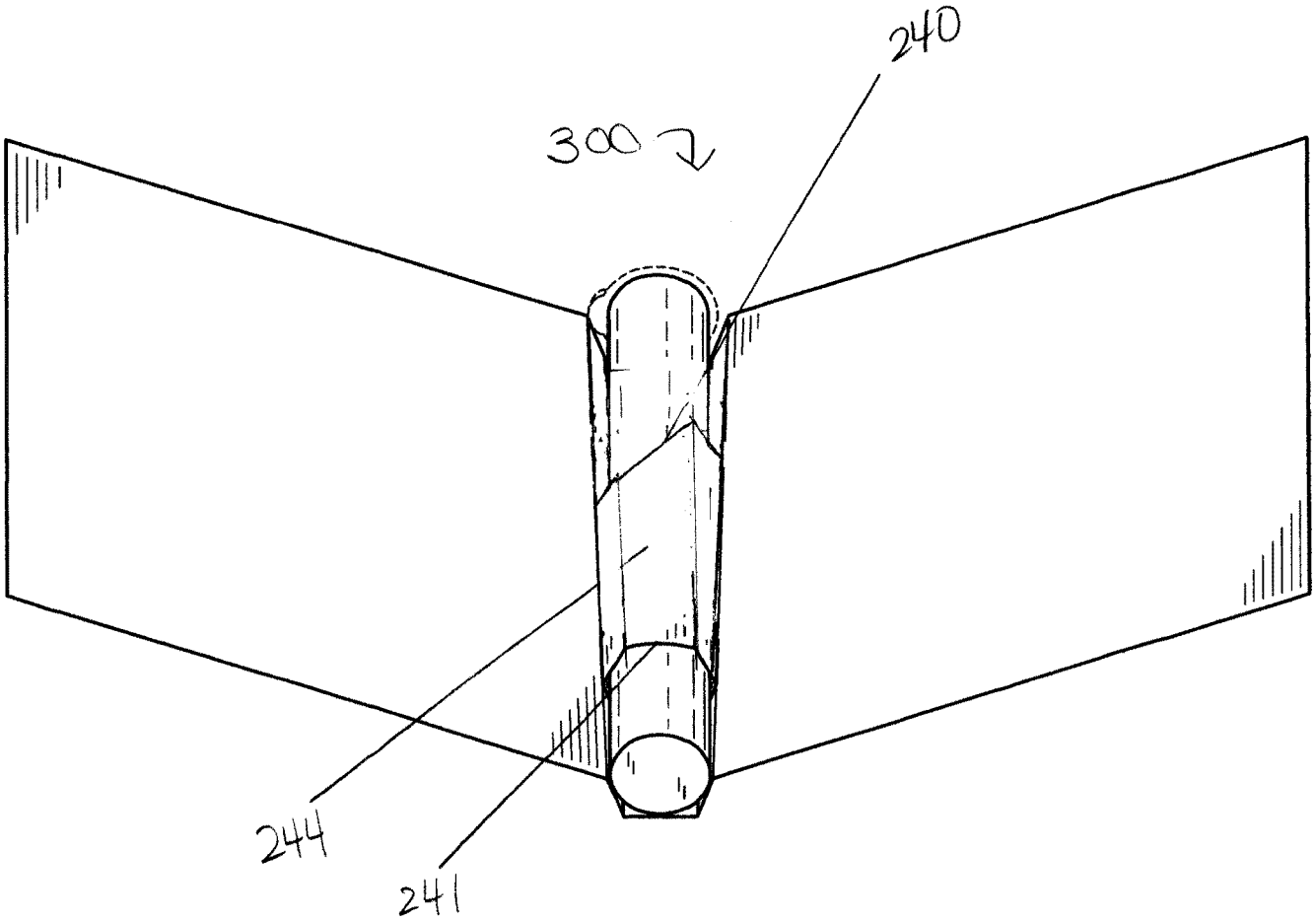
FIG. 11 is a perspective view of an alternate embodiment of the present invention in a partially folded position.
Figure 12:
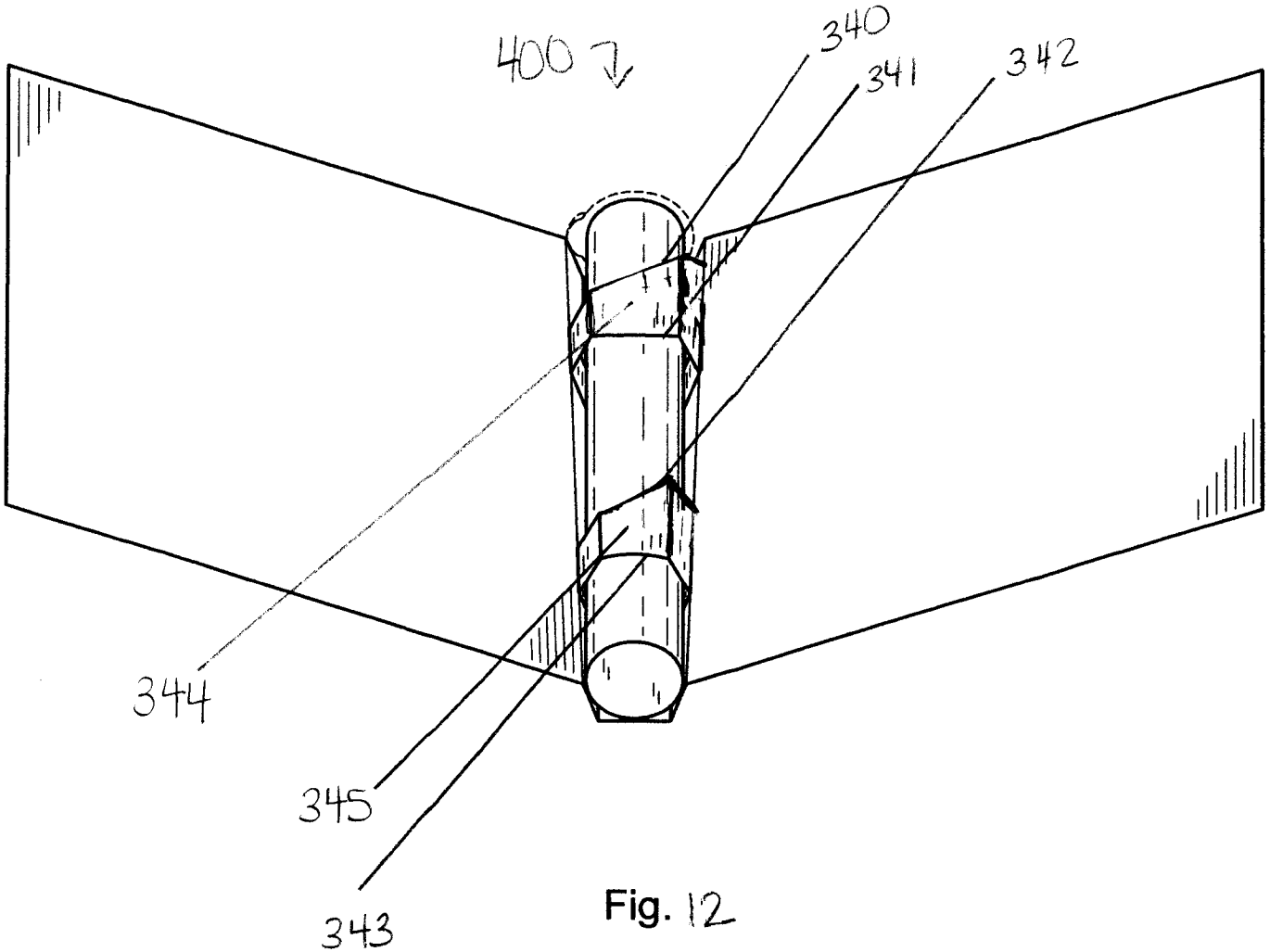
FIG. 12 is a perspective view of an alternate embodiment of the present invention in a partially folded position.

The card 5 further comprises first 40 and second 41 die cuts that extend from the first scored line 30 to the fourth scored line 33 creating a first tab 44. The first 40 and second 41 die cuts are shown in FIG. 1 to extend substantially perpendicular to a central line of symmetry of the sheet like element 10. However, the first 40 and second 41 die cuts may also extend at any angle from the first scored line 30 to the fourth scored line 33. The first 40 and second 41 die cuts may or may not be parallel to each other. The third 42 and fourth 43 die cuts extend from the first scored line 30 to the fourth scored line 43 creating second tab 45. The third 42 and fourth 43 die cuts are shown to extend substantially parallel to the first and second die cuts 40 and 41 in FIG. 1. However, the third and fourth die cuts 42 and 43 may extend at any angle from the first scored line 30 to the fourth scored line 33. The third and fourth die cuts 42 and 43 may not be parallel to each other. As shown in FIG. 12, an alternate embodiment of the card and container 400 has a first die cut 340 that is not parallel to the second die cut 341 forming a first tab 344 and the third die cut 342 is not parallel to the fourth die cut 343 forming the second tab 345. As shown in FIG. 9, the first 44 and second tabs 45 is trapezoidal in shape when the sheet like element 10 is in a planar unfolded position due to the non-perpendicular angle of the first scored line 30 and the fourth scored line 33. The first 44 and second tabs 45 may be different shapes depending on the angles of the first 40, second 41, third 42 and fourth 43 die cuts. Preferably, the width of the second tab 45 is narrower than the first tab 44 as a result of its position closer to the bottom edge 12 of the sheet like element 10. As shown in FIG. 6, the second 41 and fourth 43 die cuts each has a length extending from said first scored line 30 to said fourth scored line 33 wherein the length of said second die cut 41 is larger than said length of said fourth die cut 33. Although two tabs 44 and 45 are shown, less (such as one (see FIGS. 10 and 11)) or more (such as three or more (not shown)) tabs can be used.

Figure 10:
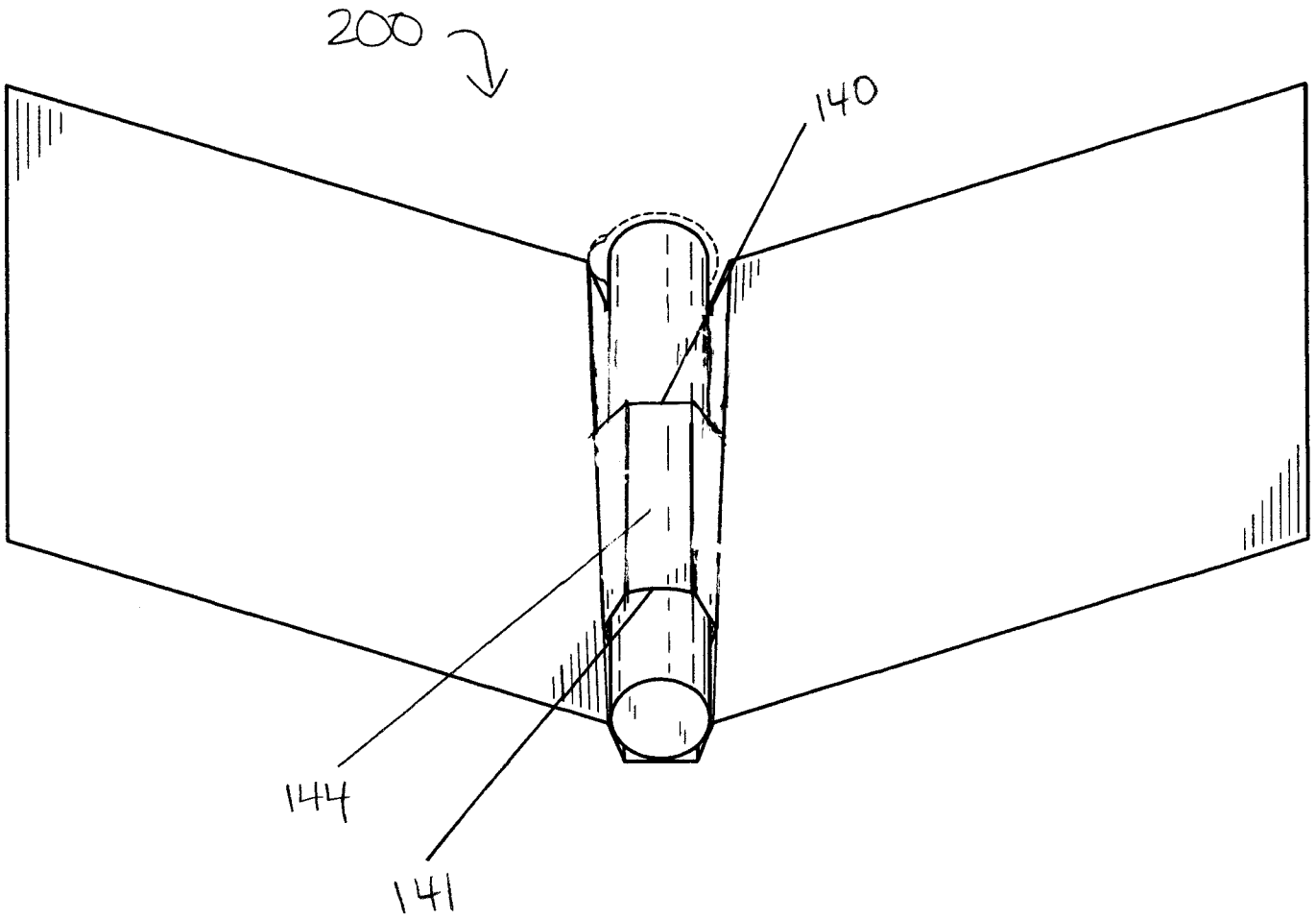
FIG. 10 is a perspective view of an alternate embodiment of the present invention in a partially folded position.

As shown in FIG. 10, in an alternate embodiment of the present invention the card and container 200 may comprise only one tab 144 formed from a pair of die cuts 140, 141 extending from said first scored line to said fourth scored line. The pair of die cuts 140, 141 may be parallel to each other forming one tab 144. The pair of die cuts 240, 241 may be not parallel to each other forming one tab 244. See FIG. 11.

Figure 8:
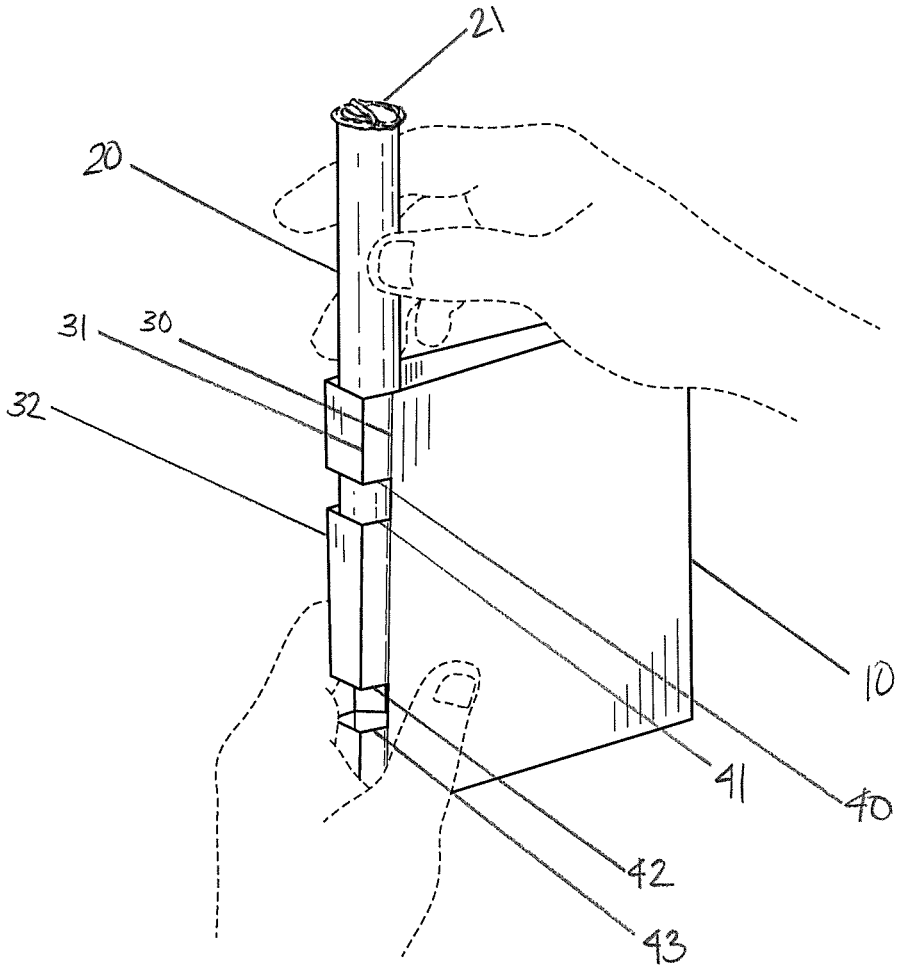
FIG. 8 is a perspective view of the present invention in a folded position with the container being inserted into the card.

The card 5 is capable of being configured from an unfolded (planar) position, as shown in FIG. 9, by folding the sheet like element 10 to a folded position as shown in FIG. 8 to take the form of a two page pamphlet or booklet. To make the card 5 of the present invention, start with a sheet like element 10. First, fold along the first scored line 30, the second scored line 31, the third scored line 32 and the fourth scored line 33. To fold the first scored line 30, place the sheet like material 10 with the first surface 50 facing downward and the second surface 51 facing up. A valley fold, known in the art of origami folding, is made on the first 30, second 31, third 32 and fourth 33 scored lines. The area bordered by the first 30 and fourth scored lines 33, and the top edge 11 and the bottom edge 12, defines the binding area 60 of the card. To create the first tab 44, the first 40 and second 41 die cuts are pulled upward and a mountain fold is created along the second scored line 31 and the third scored line 32 between the first 40 and second 41 die cuts. To create the second tab 45, the third 42 and fourth 43 die cuts are pulled upward and a mountain fold is created along the second scored line 31 and the third scored line 32 between the third 42 and fourth die cuts 43.

As shown in FIGS. 6 and 8, the present invention further comprises a container 20 that is capable of being received through the first tab 44 and second tab 45 when the card 5 is in the folded or partially folded position. In the folded position the card 5 takes the form of a booklet or pamphlet. In the partially folded position, the card 5 takes the form of a partially opened booklet or pamphlet. The container 20 is held between the first surface 50 of the first tab 44 and the second tab 45 and the second surface 51 of the binding area 60 of the card 5. As the first tab 44 is wider than the second tab 45, the container 20 can easily be inserted in between the first surface 50 of the first tab 44 and the second surface 51 of the binding area 60 of the card 5 and then slid down and fit more securely in between the first surface 50 of the second tab 45 and the second surface 51 of the binding area of the card 60. The circumference, or perimeter, of the container 20 is slightly smaller than two times the length of the fourth die cut 43 to allow the container 20 to be held snuggly by second tab 45. Although container 20 is shown as having substantially the same length as the distance from the top edge 11 of the sheet like element 10 to the bottom edge 12 of the sheet like element 10 it can be of any length, either more or less. The container 20 advantageously reinforces the binding area 60 of the card 5 and strengthens it.

The container 20 has a removable cover 21. The container 20 is made from plastic. It is contemplated that it can be made from other material such as paper, cardstock, linen, vellum, cardboard, metal, rubber, steel, etc. known to those skilled in the art. The container 20 is constructed and sized to accept various items such as money, checks, cigarettes, rolled cigarettes, cigars, herbs, candy, food, etc. The container 20 may be tubular or take the form of another shape that allows it to be received by the first tab 44 and the second tab 45. The cover 21 may be airtight, used to preserve freshness or be leak-proof. The container 20 may be used to store liquid, solids, or gases. The container 20 can also be opened ended such as a tube.

The card 5 may contain verbiage 15 and/or graphics/pictures 16 on the first, outside surface 50 on the front page of the pamphlet or card 5. Additional verbiage 17 and/or pictures/graphics (not shown) can be included on the second, inside, surface 51 on the second page of the pamphlet as is seen in traditional greeting cards as shown in FIG. 5. The card 5 and sheet like element 10 may be rectangular, square, circular or any other shape. The card 5 and sheet like element 10 may also vary in size.

The sheet like element 10 may be made from paper or cardstock. It can also be made from other materials such as vellum, plastic, linen etc. known to those skilled in the art.

Although the card 5 has been described above as having a central line of symmetry that is vertical extending from a top edge 11 to a bottom edge 12, the central line of symmetry may be horizontal such that it extends from a left edge to a right edge of a card. It is contemplated that a 90 degree rotation of the card is within the scope of the present invention. Therefore, each reference to top edge 11 can mean a left edge and each reference to bottom edge 12 can mean a right edge.

The features of the invention illustrated and described herein are the preferred embodiments. Therefore, it is understood that the appended claims are intended to cover unforeseeable embodiments with insubstantial differences that are within the spirit of the claims.

What we claim is:

1. A greeting card and container comprising:

a) a sheet like element having a first edge and a opposite second edge, a central line of symmetry extending from said first edge to said second edge, and a first scored line, a second scored line, a third scored line, a fourth scored line, a first die cut, a second die cut, a third die cut, and a fourth die cut;

i) said first, second, third and fourth scored lines extend, not perpendicularly, from said first edge of said sheet like element to said second edge of said sheet like element;

ii) said first scored line is spaced further apart from said fourth scored line at said first edge of said sheet like element than at said second edge of said sheet like element;

iii) said second scored line is spaced further apart from said third scored line at said first edge of said sheet like element than at said second edge of said sheet like element;

iv) wherein said first and second scored lines are symmetrical to said fourth and third scored lines, respectively, at said line of symmetry and said second and third scored lines are closer to said line of symmetry than said first and fourth scored lines;

v) said first and second die cuts are spaced apart from each other and extend from said first scored line to said fourth scored line creating a first tab;

vi) said third and fourth die cuts are spaced apart from each other and extend from said first scored line to said fourth scored line creating a second tab; and b) a container that is capable of being received through said first tab and said second tab.

2. The greeting card and container of claim 1 wherein said first and second die cuts extend substantially perpendicular to said line of symmetry of said sheet like element and said third and fourth die cuts extend substantially parallel to said first and second die cuts.

3. The greeting card and container of claim 1 wherein said first scored line is parallel to said second scored line and said third scored line is parallel to said fourth scored line.

4. The greeting card and container of claim 1 wherein said sheet like material further comprises a first, outside, surface and a second, opposite, inside surface; wherein said greeting card is capable of being configured from an unfolded position to a folded position to take the form of a booklet, wherein said sheet like element has a binding area which is bordered by said first and said fourth scored lines, said first edge and said second edge of said sheet like material; and wherein said container is held between said first surface of said first tab, said first surface of said second tab and said second surface of said binding area.

5. The greeting card and container of claim 1 wherein said first tab and said second tab are trapezoidal in shape.

6. The greeting card and container of claim 5 wherein said container has a circumference and said fourth die cut has a length extending from said first scored line to said fourth scored line, said circumference being slightly smaller than two times said length of said fourth die cut to allow said container to be held snuggly by said second tab.

7. The greeting card and container of claim 6 wherein said second die cut has a length extending from said first scored line to said fourth scored line, wherein said length of said second die cut is larger than said length of said fourth die cut.

8. The greeting card and container of claim 1 wherein said container has a storage cavity.

9. The greeting card and container of claim 1 wherein said container has a removable cover.

10. The greeting card and container of claim 1 wherein said container has a top and a bottom and a length extending from said top to said bottom, said length of said container being substantially equal to a distance between said first edge to said second edge of said sheet like element.

11. The greeting card and container of claim 1 wherein said sheet like material is made of a material selected from the group consisting of paper, cardstock, linen, vellum, and plastic.

12. The greeting card and container of claim 1 wherein said container is made of a material selected from the group consisting of paper, cardstock, linen, vellum, plastic, cardboard, metal, steel and rubber.

13. A greeting card and container comprising:

a) a sheet like element having a first edge and a second edge, a central line of symmetry extending from said first edge to said second edge, and a first scored line, a second scored line, a third scored line, a fourth scored line, and at least one tab;

i) said first, second, third and fourth scored lines extend, not perpendicularly, from said first edge of said sheet like element to said second edge of said sheet like element;

ii) said first scored line is spaced further apart from said fourth scored line at said first edge of said sheet like element than at said second edge of said sheet like element;

iii) said second scored line is spaced further apart from said third scored line at said first edge of said sheet like element than at said second edge of said sheet like element;

iv) wherein said first and second scored lines are symmetrical to said fourth and third scored lines, respectively, at said line of symmetry and said second and third scored lines are closer to said line of symmetry than said first and fourth scored lines;

v) said at least one tab formed from a pair of die cuts extending from said first scored line to said fourth scored line; and b) a container that is capable of being received through said at least one tab.

14. The greeting card and container of claim 13 wherein said pair of die cuts extend at an angle from said first scored line to said fourth scored line.

15. The greeting card and container of claim 13 wherein said pair of die cuts extend perpendicularly to said central line of symmetry.

16. The greeting card and container of claim 13 wherein said pair of die cuts are parallel to each other.

17. The greeting card and container of claim 13 wherein said pair of die cuts are not parallel to each other.

18. The greeting card and container of claim 13 wherein said sheet like element has first and second tabs.

* * * * *